US006450109B1

(12) United States Patent
Lu

(10) Patent No.: US 6,450,109 B1
(45) Date of Patent: Sep. 17, 2002

(54) FEEDING DEVICE FOR A HEMSTITCHING MACHINE

(75) Inventor: Ming-Yang Lu, Taichung (TW)

(73) Assignee: Three Way Industrial Co., Ltd., Taichung (TW)

( * ) Notice: Subject to any disclaimer, the term of this patent is extended or adjusted under 35 U.S.C. 154(b) by 30 days.

(21) Appl. No.: 09/946,212

(22) Filed: Sep. 5, 2001

(51) Int. Cl.[7] ..... D05B 57/02
(52) U.S. Cl. ..... 112/199; 112/302
(58) Field of Search ..... 112/141, 302, 112/253, 179, 194, 195, 199

(56) References Cited

U.S. PATENT DOCUMENTS 4,977,842 A * 12/1990 Fukao et al. ..... 112/302 X
5,076,181 A * 12/1991 Wang ..... 112/199
5,347,941 A * 9/1994 Mizuno ..... 112/302 X
5,704,302 A * 1/1998 Tseng ..... 112/302 X

* cited by examiner

*Primary Examiner*—Ismael Izaguirre
(74) *Attorney, Agent, or Firm*—William E. Pelton, Esq.

(57) ABSTRACT

A feeding device for a hemstitching machine includes a base having a feeding end with a protrusion extending from the feeding end and being inclined relative to the plane of the base. A slot is longitudinally defined in the base opposite to the feeding end. A sliding shuttle is slidably mounted on the base and has a groove defined to correspond to the protrusion of the base. The sliding shuttle includes two opposite sides each having a positioning plate attached to the sliding shuttle. A rotating shuttle rotatably attached to the base includes a U-shaped pivot seat pivotally attached to the base. A torsion spring is mounted in the pivot seat and secured between the pivot seat and the base. A drive arm extends from the pivot seat and a handle extends from the bottom of the pivot seat.

12 Claims, 5 Drawing Sheets

FEEDING DEVICE FOR A HEMSTITCHING MACHINE

BACKGROUND OF THE INVENTION

1. Field of the Invention

The present invention relates to a feeding device, and more particularly to a feeding device for a hemstitching machine.

2. Description of Related Art

With reference to FIGS. 6 and 7, a conventional feeding device (61) for a hemstitching machine (60) in accordance with the prior art is mounted on an underside of the hemstitching machine (60). The hemstitching machine (60) includes a needle (62), a feeding plate (63) and the feeding device (61). The needle (62) is mounted above the feeding device (61). The feeding plate (63) is mounted on top of the feeding device (61). The feeding device (61) comprises a plate-like base (65), and a sliding shuttle (68). The plate-like base (65) has a Λ-shaped feeding hole (66) defined in one end and a guiding rail (67) longitudinally formed on the other end of the base (65). The guiding rail (67) points toward the apex of the feeding hole (66). The sliding shuttle (68) is slidably mounted on the guiding rail (67). A lip (680) extends from the sliding shuttle (68). A pivoting tab (70) is pivotally attached to the lip (680). A torsion spring (69) is mounted between the lip (680) and the pivoting tab (70). The torsion spring (69) has a first end abutting the lip (680) and a second end abutting the pivoting tab (70). When the sliding shuttle (68) moves near the feeding hole (66), the free end of the pivoting tab (70) moves into the feeding hole (66) and always maintains contact with the guiding rail (67) because of the force applied by the torsion spring (69).

To operate the conventional feeding device for a hemstitching machine, the sliding shuttle (68) is moved away from the feeding hole (66) along the guiding rail (67), and the pivoting tab (70) twists the torsion spring (69). Then the thread (50) is pulled from the hemstitching machine by the free end of the pivoting tab (70). The thread (50) is pushed into the feeding hole (60) when the sliding shuttle (68) moves toward the feeding hole (66), and the free end of the pivoting tab (70) is pressed into the feeding hole (66) due to the restitution force of the torsion spring (69). Then the thread (50) extends through the feeding hole (66) from opposite sides of the feeding hole (66) and is ready for use.

The conventional feed device for a hemstitching machine can feed the thread to the hemstitching machine. However, it also has the following disadvantages.

1. The structure of the conventional feeding device for a hemstitching machine is complex because the lip (680), the pivoting tab (70) and the torsion spring (69) are necessary for pushing the thread (50) into the feeding hole (66).

2. To start the hemstitching machine, the user must hold the free end of the thread (50) with one hand to prevent the thread (50) from moving back through the feeding plate (63), and push the sliding shuttle (68) toward the feeding hole (66) with the other hand to pick up the thread (50) for the first stitch. Consequently, the conventional feeding device is inconvenient to operate.

The present invention has arisen to mitigate and/or obviate the disadvantages of the conventional feeding device for a hemstitching machine.

SUMMARY OF THE INVENTION

The main objective of the present invention is to provide an improved feeding device for a hemstitching machine, which is convenient to use and has a simplified structure.

To achieve the objective, the feeding device for a hemstitching machine in accordance with the present invention includes a base having a feeding end with a protrusion extending from the feeding end and being inclined relative to the plane of the base. A slot is longitudinally defined in the base opposite to the feeding end. A sliding shuttle is slidably mounted on the base and has a groove defined to correspond to the protrusion of the base. The sliding shuttle includes two opposite sides each having a positioning plate attached to the sliding shuttle. A rotating shuttle is rotatably mounted on the base and includes a U-shaped pivot seat pivotally connected to the base. A torsion spring is mounted in the pivot seat and secured between the pivot seat and the base. A drive arm extends from the pivot seat, and a handle extends from the bottom of the pivot seat.

Further benefits and advantages of the present invention will become apparent after a careful reading of the detailed description with appropriate reference to the accompanying drawings.

DETAILED DESCRIPTION OF THE INVENTION

Figure 1:
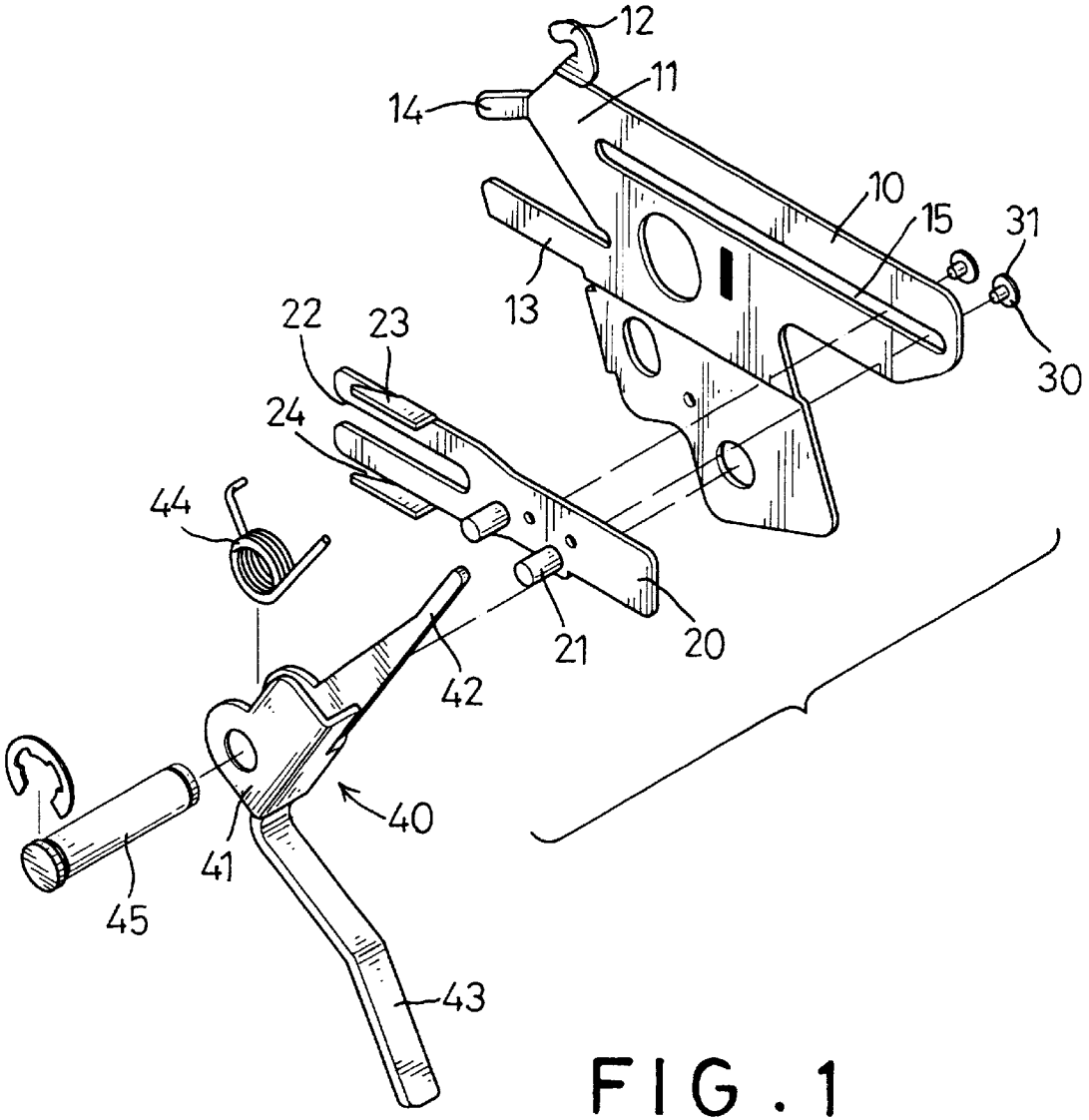
FIG. 1 is an exploded perspective view of a feeding device for a hemstitching machine in accordance with the present invention.
Figure 2:
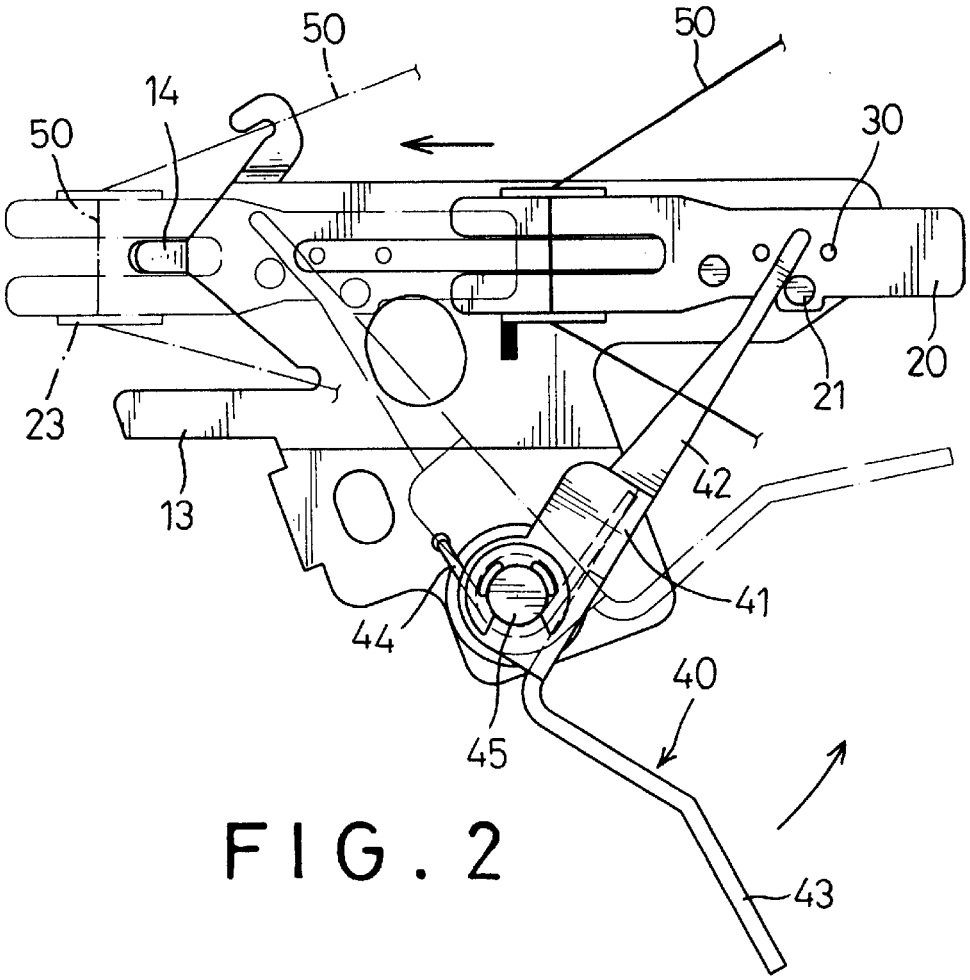
FIG. 2 is an operational front plan view of the feeding device in FIG. 1 when the sliding shuttle is away from the feed end.

With reference to the drawings and initially to FIGS. 1 and 2, a feeding device for a hemstitching machine in accordance with the present invention comprises a plate-like base (10), a sliding shuttle (20) and a rotating shuttle (40). The sliding shuttle (20) has two sides and is slidably mounted on the base (10). The rotating shuttle (40) is pivotally attached to the base (40) to drive the sliding shuttle (20).

The base (10) comprises a Σ-shaped feeding end (11) having a top and a bottom. A main feed bar (12) extends from the top of the feeding end (11), and a secondary feed bar (13) extends from the bottom of the feeding end of the base (10). A protrusion (14) extends from a middle portion of the feeding end ( 11) of the base (10) and is inclined relative to the plane of the base (10). A slot (15) is longitudinally defined in the base (10) and aligns with the protrusion (14) on the feeding end (11).

Two fasteners (30) extends through the slot (15) in the base (10) and attach to the sliding shuttle (20) so the sliding shuttle (20) slides on the base (10) along the slot (15) in the base (10). Each fastener (30) has a head (31) with a diameter greater than a width of the slot (15) to prevent the sliding shuttle (20) from detaching from the base (10). One side of the sliding shuttle (20) slides against the base (10), and two studs (21) perpendicularly extend from the other side of the sliding shuttle (20). The sliding shuttle (20) has one end corresponding to the feeding end (11) of the base (10) with a longitudinal groove (22) defined in the end of the sliding shuttle (20). The groove (22) in the sliding shuttle (20) is parallel to the slot (15) in the base (10) and selectively receives the protrusion (14) on the base (10). The sliding shuttle (20) includes two edges with a positioning plate (23) perpendicularly attached to each edge near the end containing the groove (22) and opposite to the base (10). A tapered indent (24) is defined in the positioning plate (23) between the positioning plate (23) and the end of the sliding shuttle (20).

The rotating shuttle (40) comprises a U-shaped pivot seat (41) formed to hold a torsion spring (44). The torsion spring (44) has a first end secured in the base (10) and a second end abutting a bottom of the pivot seat (41). A pivot pin (45) extends through the pivot seat (41), the torsion spring (44) and the base (10) to pivotally attach the rotating shuttle (40) to the base (10). A drive arm (42) extends from the pivot seat (41) and is mounted between the two studs (21) on the sliding shuttle (20). A handle (43) extends downwardly from the pivot seat (41) of the rotating shuttle (40) for the user to operate the feeding device.

Figure 3:
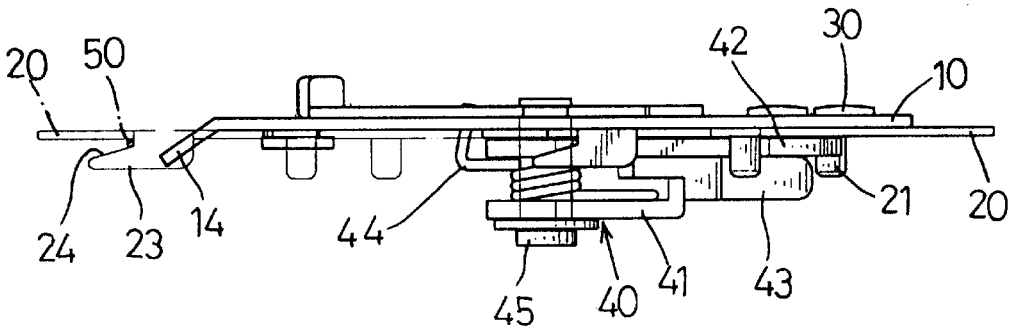
FIG. 3 is a top plan view of the feeding device in FIG. 2.
Figure 4:
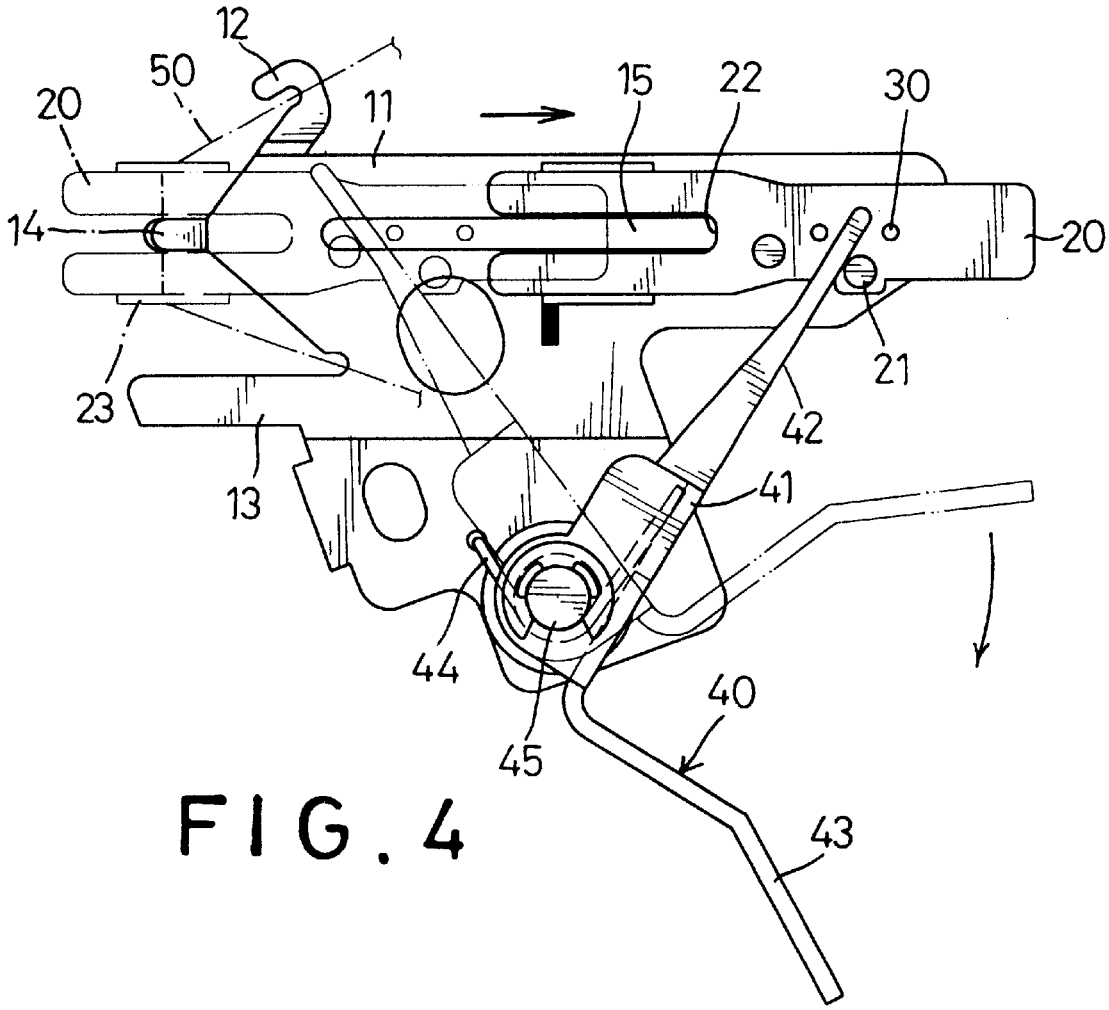
FIG. 4 is an operational front plan view of the feeding device in FIG. 1 when the sliding shuttle is close to the feeding end.
Figure 5:
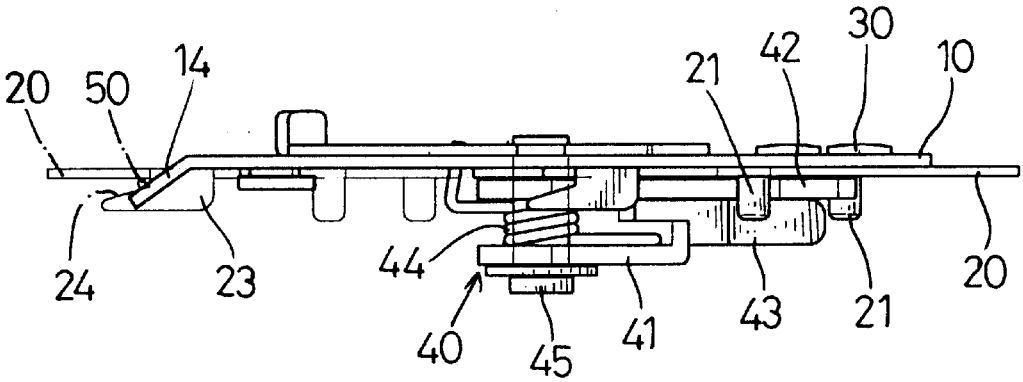
FIG. 5 is a top plan view of the deeding device in FIG. 4.
Figure 6:
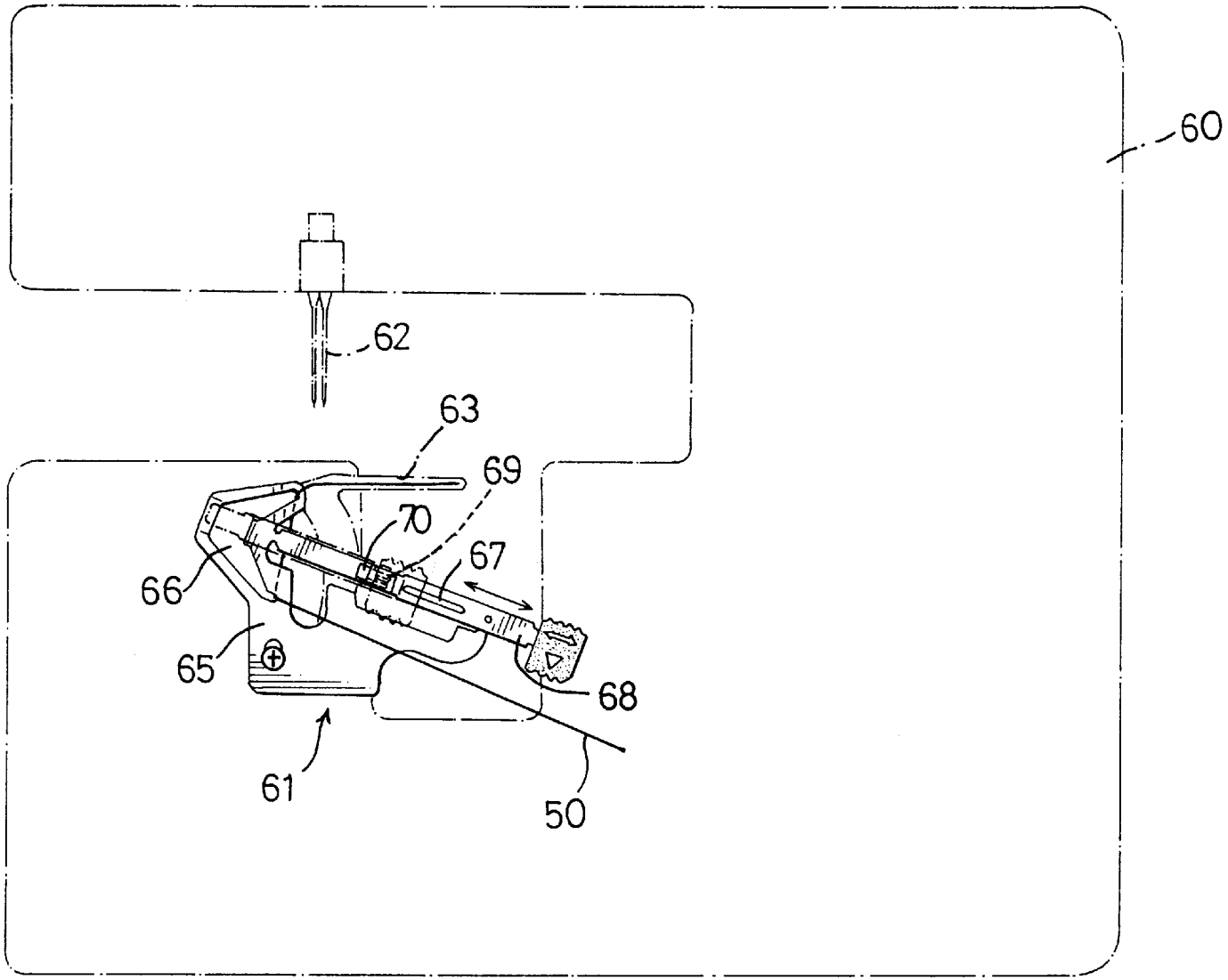
FIG. 6 PRIOR ART
FIG. 6 is a front plan view of a conventional feeding device for a hemstitching machine in accordance with the prior art.
Figure 7:
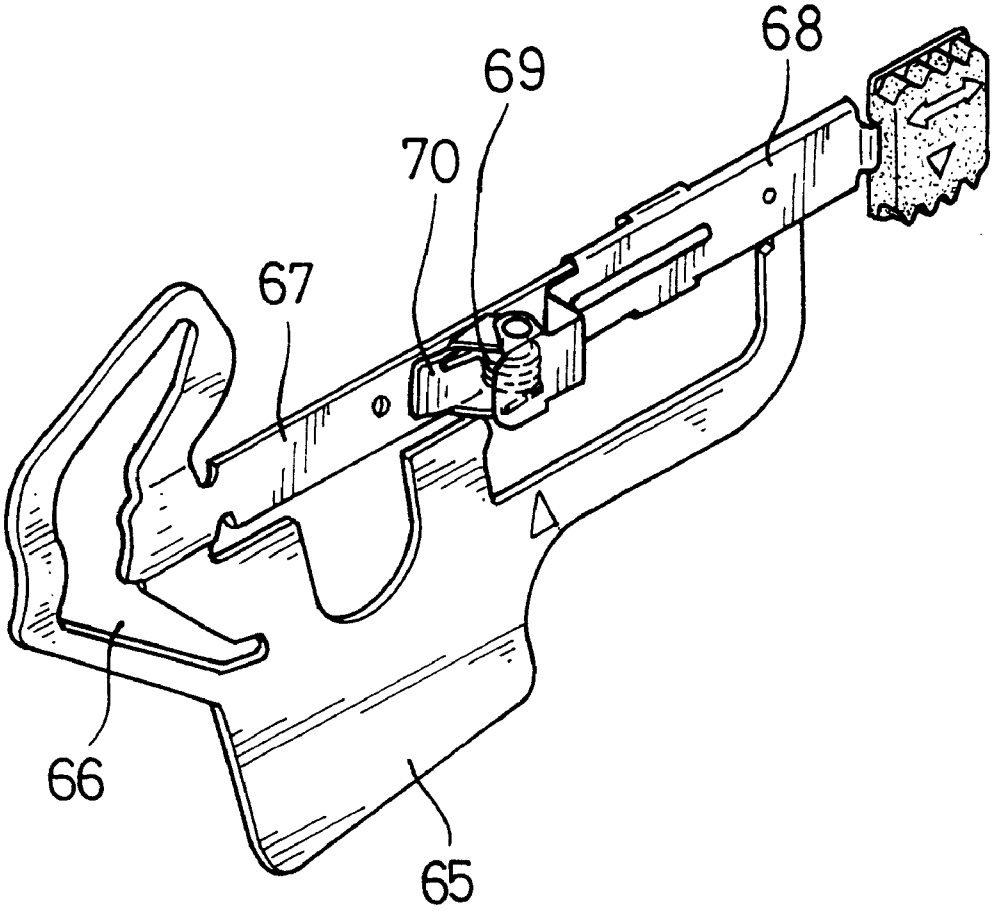
FIG. 7 PRIOR ART
FIG. 7 is a perspective view of a feeding device in FIG. 6.

With reference to FIGS. 2 and 3, to operate the feeding device, the sliding shuttle (20) is moved away from the feeding end (11) of the base (10) along the slot (15) in the base (10). The thread (50) is pulled to be received in the indent (24) and then the user pulls the handle (43) to make the drive arm (42) push the sliding shuttle (20) toward the feeding end (11) of the base (10) along the slot (15) in the base (10). Further with reference to FIGS. 4 and 5, the handle (43) is released, and the drive arm (42) drives the sliding shuttle (20) away from the feeding end (11) of the base (10) due the restitution force of the torsion spring (44) after the thread (50) passes over the protrusion (14) of the base (10). Consequently, the thread (50) is pulled laterally and passed over the secondary feed bar (13) and the main feed bar (12).

The feeding device for a hemstitching machine in accordance with the present invention has the following advantages.

1. It is convenient to use. The protrusion (14) extends from a middle portion of the feeding end (11) of the base (10) and is inclined relative to the plane of the base (10) so that the thread (50) is automatically hooked by the feeding end (11) when the thread (50) passes over the protrusion (14) and the sliding shuttle (20) moves away from the feeding end (11).

2. The indent (24) in the positioning plate (23) can clamp the thread (50) to prevent the thread (50) from detaching from the sliding shuttle (20) during feeding.

Although the invention has been explained in relation to its preferred embodiment, it is to be understood that many other possible modifications and variations can be made without departing from the spirit and scope of the invention as hereinafter claimed.

What is claimed is:

1. A feeding device for a hemstitching machine comprising:

a base including a feeding end having a protrusion extending from the feeding end and being inclined relative to a plane of the base, and a slot longitudinally defined in one end of the base opposite to the feeding end;

a sliding shuttle slidably mounted on the base and having a groove defined to correspond to the protrusion of the base, the sliding shuttle having two opposite edges each having a positioning plate perpendicularly attached to the sliding shuttle near the end containing the groove and opposite to the base, the positioning plate adapted to hold a thread during feeding; and a rotating shuttle rotatably mounted on the base to drive the sliding shuttle moved back and forth, the rotating shuttle including:

a U-shaped pivot seat pivotally attached to the base by a pivot pin extending through the U-shaped pivot seat and the base;

a torsion spring received in the U-shaped pivot seat and penetrated by the pivot pin, the torsion spring has a first end secured on the base and a second end abutting a bottom of the U-shaped pivot seat;

a drive arm extending from one side of the U-shaped pivot seat to drive the sliding shuttle; and a handle extending from the bottom of the U-shaped pivot seat for a user to rotate the rotating shuttle.

2. The feeding device for a hemstitching machine as claimed in claim 1, wherein the feeding end of the base is Σ-shaped and has an upper portion and a lower portion, and the base comprises a main feed bar extending from the upper portion of the feeding end and a secondary feed bar extending from the lower portion of the feeding end.

3. The feeding device for a hemstitching machine as claimed in claim 1, wherein the sliding shuttle comprises a tapered indent defined in the positioning plate between the positioning plate and the sliding shuttle adapted to hold the thread during feeding.

4. The feeding device for a hemstitching machine as claimed in claim 1, wherein the sliding shuttle comprises two studs extending from one side of the sliding shuttle opposite to the base, and the drive arm of the rotating shuttle is mounted between the two studs.

5. The feeding device for a hemstitching machine as claimed in claim 1 further comprising two fasteners extending through the slot in the base and secured on the sliding shuttle to hold the sliding shuttle in place on the base.

6. The feeding device for a hemstitching machine as claimed in claim 2 further comprising two fasteners extending through the slot in the base and secured on the sliding shuttle to hold the sliding shuttle in place on the base.

7. The feeding device for a hemstitching machine as claimed in claim 3 further comprising two fasteners extending through the slot in the base and secured on the sliding shuttle to hold the sliding shuttle in place on the base.

8. The feeding device for a hemstitching machine as claimed in claim 4 further comprising two fasteners extending through the slot in the base and secured on the sliding shuttle to hold the sliding shuttle in place on the base.

9. The feeding device for a hemstitching machine as claimed in claim 5, wherein the sliding shuttle comprises two studs extending from one side of the sliding shuttle opposite to the base, and the drive arm of the rotating shuttle is mounted between the two studs.

10. The feeding device for a hemstitching machine as claimed in claim 6, wherein the sliding shuttle comprises two studs extending from one side of the sliding shuttle opposite to the base, and the drive arm of the rotating shuttle is mounted between the two studs.

11. The feeding device for a hemstitching machine as claimed in claim 7, wherein the sliding shuttle comprises two studs extending from one side of the sliding shuttle opposite to the base, and the drive arm of the rotating shuttle is mounted between the two studs.

12. The feeding device for a hemstitching machine as claimed in claim 8, wherein the sliding shuttle comprises two studs extending from one side of the sliding shuttle opposite to the base, and the drive arm of the rotating shuttle is mounted between the two studs.

* * * * *